US008147222B2

(12) United States Patent
Mordehai et al.

(10) Patent No.: US 8,147,222 B2
(45) Date of Patent: Apr. 3, 2012

(54) VACUUM DIVIDER FOR DIFFERENTIAL PUMPING OF A VACUUM SYSTEM

(75) Inventors: Alexander Mordehai, Santa Clara, CA (US); Mark Werlich, Los Altos, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 944 days.

(21) Appl. No.: 11/749,083

(22) Filed: May 15, 2007

(65) Prior Publication Data

US 2008/0283125 A1 Nov. 20, 2008

(51) Int. Cl.
*F04B 35/04* (2006.01)

(52) U.S. Cl. ..... 417/423.4; 250/281

(58) Field of Classification Search ..... 417/423.4, 417/562, 567, 569, 571; 137/101; 415/191; 250/281, 292
See application file for complete search history.

(56) References Cited

U.S. PATENT DOCUMENTS

| | | | | |
|---|---|---|---|---|
| 4,581,533 | A * | 4/1986 | Littlejohn et al. | 250/282 |
| 5,482,430 | A * | 1/1996 | Hablanian | 415/90 |
| 5,565,679 | A * | 10/1996 | Tanner et al. | 250/288 |
| 5,733,104 | A * | 3/1998 | Conrad et al. | 417/44.1 |
| 6,014,892 | A * | 1/2000 | Baret et al. | 73/40.7 |
| 6,142,163 | A * | 11/2000 | McMillin et al. | 137/14 |
| 6,589,009 | B1 * | 7/2003 | Shiokawa et al. | 415/90 |
| 7,033,142 | B2 * | 4/2006 | Conrad et al. | 417/201 |
| 2003/0222213 | A1 * | 12/2003 | Taniguchi | 250/292 |

* cited by examiner

*Primary Examiner* — Devon C Kramer
*Assistant Examiner* — Amene Bayou

(57) ABSTRACT

A vacuum divider is positioned between rotor blades of a turbo-molecular pump and a vacuum manifold formed from multiple vacuum chambers. A first coupling aperture passes through the vacuum divider and allows gas to pass from a first of the multiple vacuum chambers to the turbo-molecular pump. A second coupling aperture passes through the vacuum divider and allows gas to pass from a second of the multiple vacuum chambers to the turbo-molecular pump.

18 Claims, 5 Drawing Sheets

VACUUM DIVIDER FOR DIFFERENTIAL PUMPING OF A VACUUM SYSTEM

FIELD OF THE INVENTION

The invention relates to the field of vacuum systems, and more specifically to differential pumping of vacuum systems.

BACKGROUND OF THE INVENTION

Typical turbo-molecular pumps such as those manufactured by BOC Edwards of Crawley, West Sussex, United Kingdom ("Edwards") and Pfeiffer Vacuum Inc. of NH, USA ("Pfeiffer") have a single high vacuum inlet at the top of the rotor stack designed to evacuate a single vacuum region.

Some turbo-molecular pumps also have inter-stage ports that allow for pumping of more than one vacuum region. For example, the Edwards EXT255H is a compound molecular pump with a high-vacuum stage and a drag stage (see U.S. Pat. No. 6,709,228B2 to Stuart). This configuration allows for pumping on two vacuum regions, one high vacuum and one low vacuum. However, an additional one of these pumps would be required to evacuate a second high vacuum region.

There are also "split flow" turbo-molecular pumps, such as the Edwards EXT200/200/30, which create a second high vacuum stage by placing a port in the side of the turbo-molecular section of the pump, at a distance of a few rotor blade heights downstream from the high vacuum inlet.

However, both the compound and split flow types of pumps increase the cost of the pumping system and require more space for the vacuum pumps.

There are some turbo-molecular pumps, such as the Pfeiffer TMH 262-020YP, that have a support structure above the top rotor blades in the high vacuum inlet. This structure is used to support the rotor shaft bearing at the top of the rotor stack. The gap between the structure and the rotor blades is roughly one-half the width of the support. There is no provision to mate the support structure to the vacuum manifold to create multiple vacuum regions. Thus, this structure is only used as a support structure and does not result in the division of the turbo-molecular pump's high-vacuum inlet into more than one vacuum region for differential pumping.

The cost of the pumping system in instruments using a vacuum system can be a significant portion of the total cost of the instrument. The addition of another vacuum pump or the use of a more costly vacuum pump can be a significant cost disadvantage. It can also result in bulky and difficult to manage vacuum systems.

It would be desirable to provide a low cost and compact pumping system for pumping a differential vacuum between several vacuum chambers of a vacuum system.

SUMMARY OF THE INVENTION

These and other objects are provided by the present invention which provides a divider in the high vacuum inlet of a turbo-molecular pump allowing for the evacuation of a second high vacuum region without a significant increase in the cost of the pumping system.

In general terms an embodiment of the invention is a vacuum divider positioned between rotor blades of a turbo-molecular pump and a vacuum manifold formed from multiple vacuum chambers. A first coupling aperture passes through the vacuum divider and allows gas to pass from a first of the multiple vacuum chambers to the turbo-molecular pump. A second coupling aperture passes through the vacuum divider and allows gas to pass from a second of the multiple vacuum chambers to the turbo-molecular pump.

BRIEF DESCRIPTION OF THE FIGURES

Further preferred features of the invention will now be described for the sake of example only with reference to the following figures, in which.

DETAILED DESCRIPTION OF THE EMBODIMENTS

Figure 1:
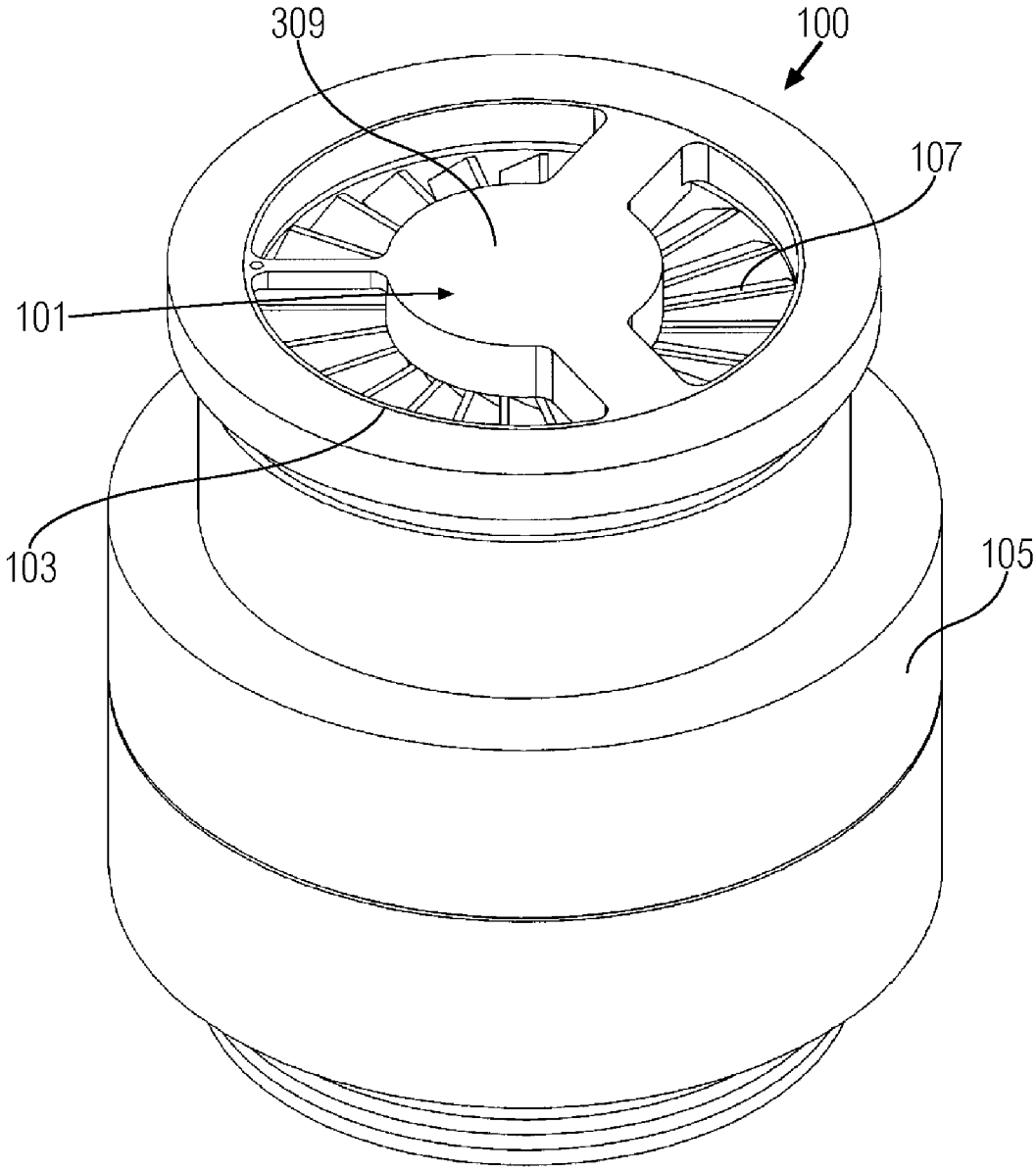
FIG. 1 is a top perspective view of a turbo-molecular pump with a vacuum divider of the present invention mounted thereon.
Figure 2:
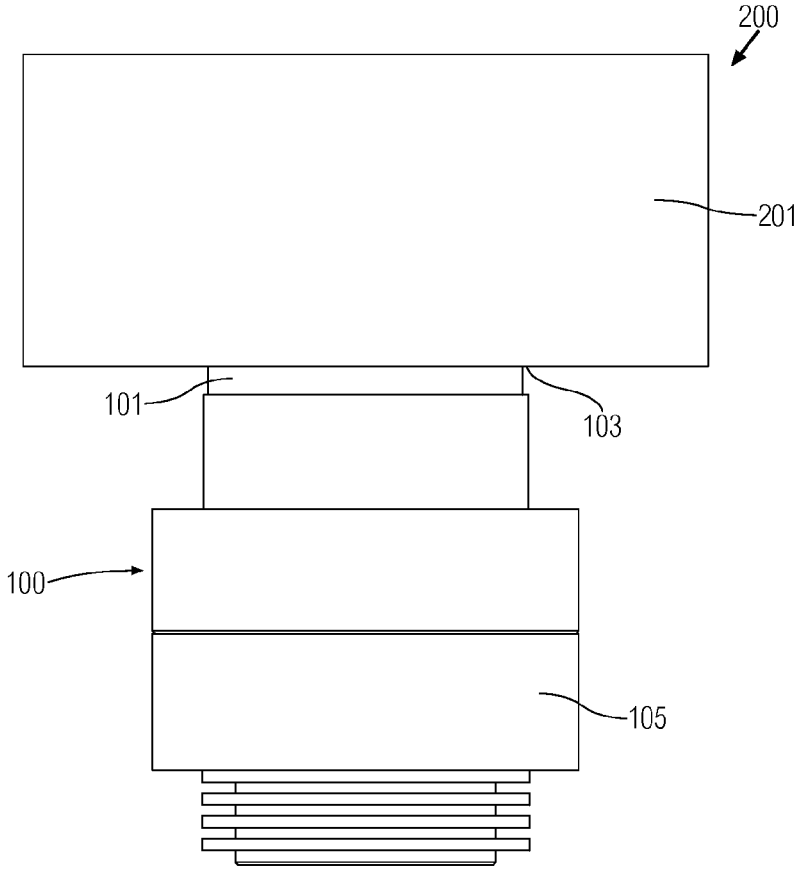
FIG. 2 is a side plan view of an assembly formed from the vacuum divider of FIG. 1 seated between the turbo-molecular pump and a vacuum manifold.

Referring to FIGS. 1 and 2, the present invention combines a vacuum divider 101 and a vacuum manifold 201 with a turbo-molecular pump 105 in order to pump a differential vacuum between several vacuum chambers of a portion of a vacuum system 100. This invention can dramatically decrease the cost of the vacuum system by allowing a single relatively inexpensive turbo-molecular pump, rather than several independent pumps, to be used to pump this differential vacuum. Moreover, this invention provides a system much more compact than the prior-art.

A vacuum divider 101 is installed at a high vacuum inlet 103 of a turbo-molecular pump 105 in close proximity to the top of rotor blades 107 of the turbo-molecular pump 105. The turbo-molecular pump 105 can be a Pfeiffer THM 261-020 YP, for example.

FIG. 2 is a side plan view of the portion of the vacuum system 100 with an added vacuum manifold 201 attached to form a vacuum assembly 200. The vacuum divider 101 is seated between the rotor blades 107 of turbo-molecular pump 105 and the vacuum manifold 201. In this embodiment, the vacuum divider 101 is shown installed at the high vacuum inlet 103, but in other embodiments it can be located upstream or downstream from the high vacuum inlet 103 so long as it is located between the rotor blades 107 of turbo-molecular pump 105 and the vacuum manifold 201 at a position relatively close to the rotor blades 107.

The vacuum divider 101 can be attached to the turbo-molecular pump 105 and the vacuum manifold 201 by a vacuum-tight seal. A vacuum-tight seal is defined as a seal where the leak rate into a vacuum chamber through the seal is small enough so as not to substantially affect the vacuum level within the vacuum chamber. Removable, vacuum-tight connections can be used to connect the vacuum divider 101 to the turbo-molecular pump 105 and/or vacuum manifold 201 using copper gasket/knife edge vacuum connections, o-ring connections, zero-clearance matching flat surfaces, overlapping joints, or other methods known in the art. Also, the vacuum divider 101 can be welded to either the turbo-molecular pump 105 or the vacuum manifold 201 or both of them.

In other embodiments the vacuum divider 101 is integral with the turbo-molecular pump 105 or the vacuum manifold 201. For example, the vacuum divider 101 can be machined as a single piece with either the turbo-molecular pump 105 or the vacuum manifold 201 or both of them. This eliminates the need to fabricate the vacuum divider 101 as a separate part.

Figure 3:
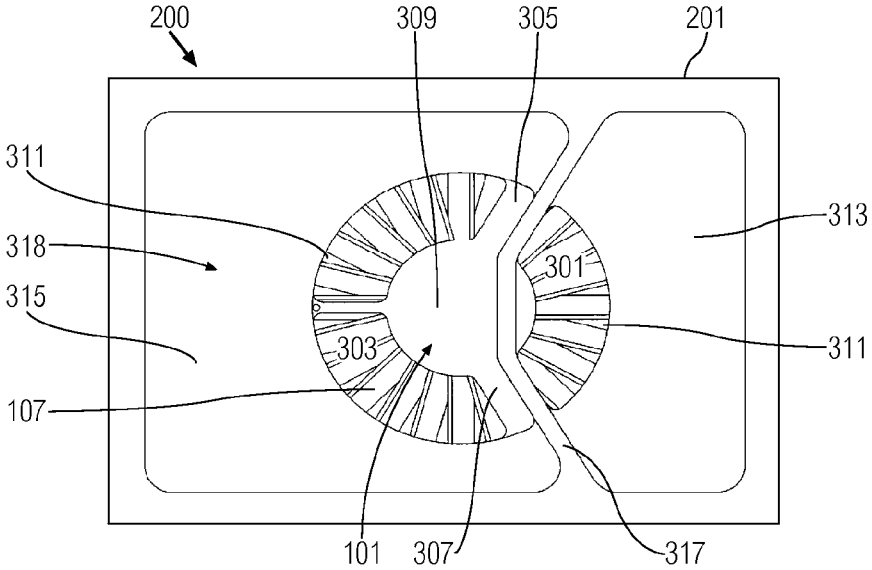
FIG. 3 is a top plan view of the assembly of FIG. 2 having apertures in the vacuum divider formed by radially extending ribs and a bulkhead wall of the vacuum manifold following along the ribs.

FIG. 3 is a top plan view of the vacuum assembly 200. In this embodiment of the invention a first coupling aperture 301 and a second coupling aperture 303 pass through the vacuum divider 101. These apertures 301, 303 in the vacuum divider 101 are formed by radially extending ribs 305, 307. The ribs 305, 307 extend from a divider central portion 309 (also shown in FIG. 1) which covers the rotor shaft area at the top of the rotor stack. The apertures are additionally formed by aperture walls 311 through the vacuum divider 101. As can be seen from the figure, the first and second coupling apertures 301, 303 are separated by the rib 305 crossing the vacuum divider 101 and also by the rib 307 crossing the vacuum divider 101.

The vacuum manifold 201 includes a first vacuum chamber 313 and a second vacuum chamber 315. A bulkhead wall 317 of the vacuum manifold 201 divides the manifold 201 into the first vacuum chamber 313 and the second vacuum chamber 315. The bulkhead wall 317 follows and is sealed with a vacuum-tight seal to the ribs 305, 307. The ribs 305, 307 are aligned with the bulkhead wall 317 so that the first coupling aperture 301 and first vacuum chamber 313 form a first continuous space and the second coupling aperture 303 and the second vacuum chamber 315 form a second continuous space. Thus, the first coupling aperture 301 is fixed with a vacuum-tight seal to the first vacuum chamber 313 and the second coupling aperture 303 is fixed with a vacuum-tight seal to the second vacuum chamber 315. Also, the first coupling aperture 301 allows gas to pass from the first vacuum chamber 313 to the turbo-molecular pump 105 and the second coupling aperture 301 allows gas to pass from the second vacuum chamber 313 to the turbo-molecular pump 105.

A "pump inlet area allocation" is defined to be the area of each coupling aperture expressed as a percentage of the total area of all coupling apertures. The pump inlet area allocation of all apertures should add up to 100%. The ribs 305, 307 and the divider central portion 309 are not considered in the calculation of pump inlet area. In this embodiment, the pump inlet area allocation can be set at 32% for the vacuum chamber 313 and 68% for the vacuum chamber 315, for example.

In some embodiments the vacuum manifold 201 includes a floor 318 with it's own coupling apertures passing through the floor and corresponding to the first and second coupling apertures 301, 303 of the vacuum divider 101.

The invention also encompasses embodiments having additional coupling apertures passing through the vacuum divider for allowing gas to pass from additional ones of the multiple vacuum chambers, through the vacuum divider 101 and into the turbo-molecular pump 105. For example, the vacuum divider 101 can include three or more coupling apertures and the vacuum manifold 201 can include three or more vacuum chambers. Then each of the coupling apertures allows gas to pass from one of the vacuum chambers, through the vacuum divider 101 and into the turbo-molecular pump 105. The single turbo-molecular pump 105 can thereby pump three or more vacuum chambers of the vacuum system to produce three or more different vacuum pressures.

Figure 4:
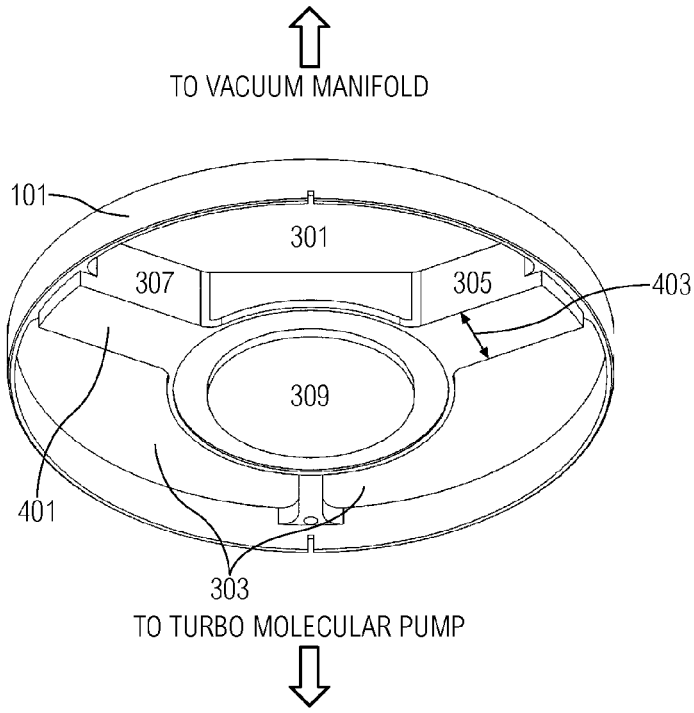
FIG. 4 is a bottom perspective view of an embodiment of the vacuum divider of FIG. 1 having a flat bottom surface of the ribs.
Figure 9:
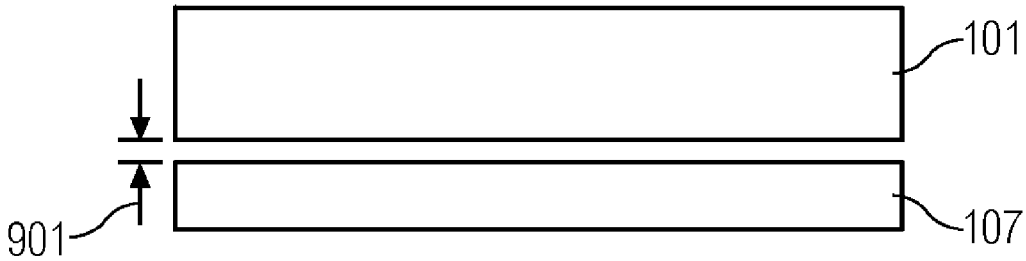
FIG. 9 is a diagrammatic view, not to scale, of the closest distance between the vacuum divider and the rotor blades.

FIG. 4 is a bottom perspective view of an embodiment of the vacuum divider 101 having a flat rotor-blade-directed face 401 of the ribs 305, 307 separating the coupling apertures 301, 303. The vacuum divider 101 is located between the rotor blades 107 of the turbo-molecular pump 105 and the vacuum manifold 201 at a position relatively close to the rotor blades 107. This distance relative to the rotor blades 107 is preferably fixed so that the closest distance between the vacuum divider 101 and the rotor blades of the turbo-molecular pump 105 is less than 30% of a minimum width 403 of the ribs 305, 307. This gap distance 901 is shown schematically in FIG. 9 as the closest distance 901 (note: the figure is not drawn to scale). For various shaped coupling apertures 301, 303, in general, the minimum width is the minimum width 403 of the rotor-blade-directed face 401 separating the coupling apertures. Thus, in a more general embodiment, the position of the vacuum divider 101 is fixed relative to the turbo-molecular pump 105 so that the closest distance 901 between the flat rotor-blade-directed face 401 and the rotor blades of the turbo-molecular pump 105 is less than 30% of the minimum width 403 of the rotor-blade-directed face 401 separating the coupling apertures.

In one embodiment the vacuum divider 101 of FIG. 4 is inserted into the high vacuum inlet 103 of the turbo-molecular pump 105 of FIG. 2, where the turbo-molecular pump can be the Edwards model EXT255H. The divider can then be mated with a matching flat surface on the vacuum manifold 201. O-rings can be used to seal the turbo-molecular pump flange and the vacuum divider 101 to the vacuum manifold 201. Thus the two distinct vacuum chambers 313, 315 are created.

Figure 5:
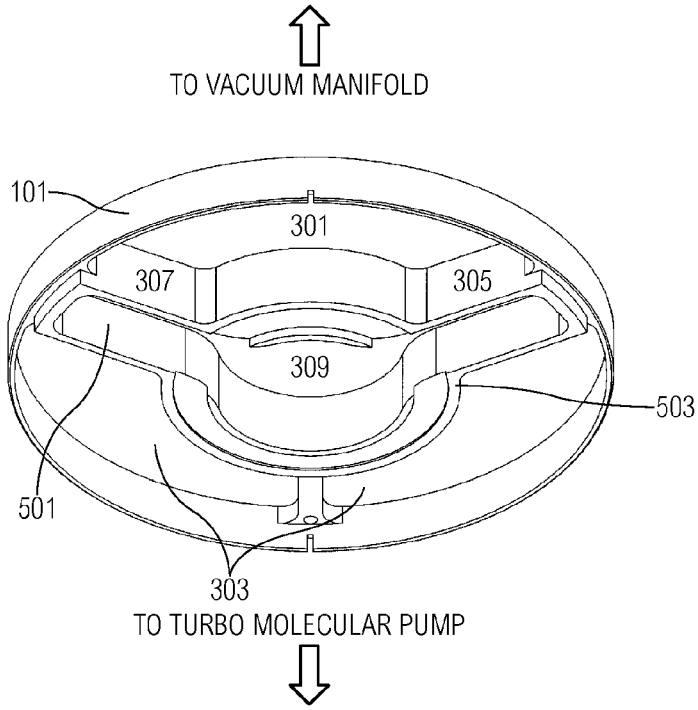
FIG. 5 is a bottom perspective view of an embodiment of the vacuum divider of FIG. 1 utilizing a channel formed in the bottom surface of the ribs.

FIG. 5 is a bottom perspective view of another embodiment of the vacuum divider 101 having a rotor-blade-directed face 503 of the ribs 305, 307 separating the coupling apertures 301, 303, similar to the embodiment of FIG. 4, but with the addition of a channel 501 formed in the rotor-blade-directed face 503. The purpose of the channel 501 of this embodiment of the vacuum divider 101 is to create an intermediate vacuum region between the two vacuum chambers 313, 315 of the vacuum manifold 201. This decreases the amount of gas that can pass between the apertures 301, 303 and thereby improves the differential pumping between the vacuum chambers 313, 315.

Figure 6:
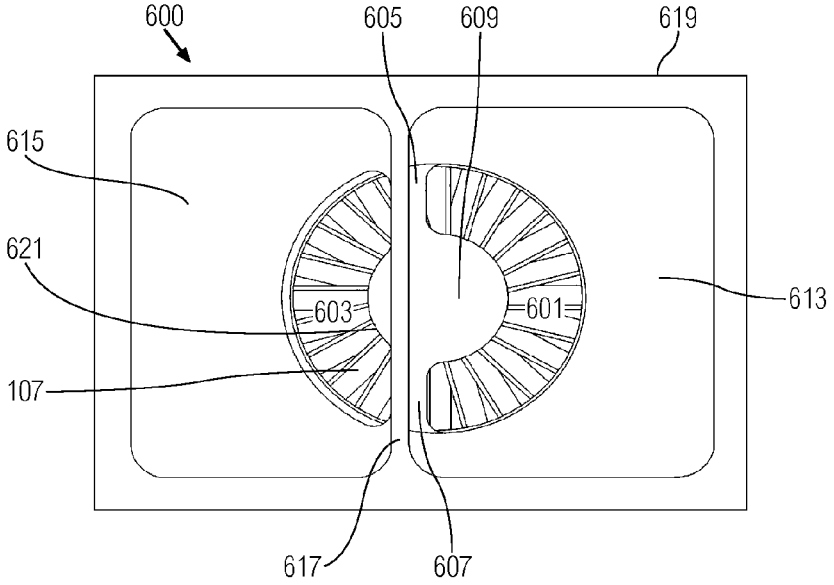
FIG. 6 is a top plan view of the assembly of FIG. 2 having apertures in the vacuum divider formed by bisecting ribs and a bulkhead wall of the vacuum manifold following along the ribs.

FIG. 6 is a top plan view of a variation 600 of the vacuum assembly 200 of FIG. 3. In this embodiment coupling apertures 601, 603 in the vacuum divider 621 are formed by bisecting ribs 605, 607, which extend from a divider central portion 609, and a bulkhead wall 617 of the vacuum manifold 619 follows along the ribs 605, 607. This embodiment results in the coupling apertures 601, 603 and vacuum chambers 613, 615 having different relative sizes and shapes as compared to the vacuum assembly 200 of FIG. 3. In this embodiment, the pump inlet area allocation can be set at 60% for the vacuum chamber 613 and 40% for the vacuum chamber 615, for example.

Experimental prototypes of the vacuum divider 101 were built and tested. The vacuum dividers were inserted into the high vacuum inlet of an Edwards EXT255H turbo-molecular pump. With a vacuum divider installed, the turbo-molecular pump was mounted to a vacuum manifold. The vacuum divider used for the tests had the radially extending ribs 305, 307 of FIG. 3 and the bulkhead wall 317 following along the ribs. Ion gauges were used to measure the pressure in each of the two vacuum chambers 313, 315.

A precision leak valve was added to the vacuum chamber 313 to allow for an adjustable gas load. The vacuum chamber 315 had no external gas load. Thus, during the tests, the vacuum chamber 313 was at a higher pressure than the vacuum chamber 315.

A "Differential Pumping Ratio" ("DPR"), is defined as the pressure in the vacuum chamber 313 divided by the pressure in the vacuum chamber 315. During testing of the prototypes, four different parameters were varied to find their effect on the DPR:

1. The vacuum divider design of FIG. 4 (flat rotor-blade-directed face 401 of the ribs 305, 307) and the divider design of FIG. 5 (channel 501 cut into the rotor-blade-directed face 503) were used.

2. The closest distances between both of the rotor-blade-directed faces 401, 503 and the rotor blades 107 were set to both 0.75 mm or 1.50 mm.

3. The pump inlet area allocation was set at 68% for the vacuum chamber 313 and 32% for the vacuum chamber 315 and also set at 32% for the vacuum chamber 313 and 68% for the vacuum chamber 315.

4. The gas load was varied by changing the precision leak valve settings.

Figure 7:
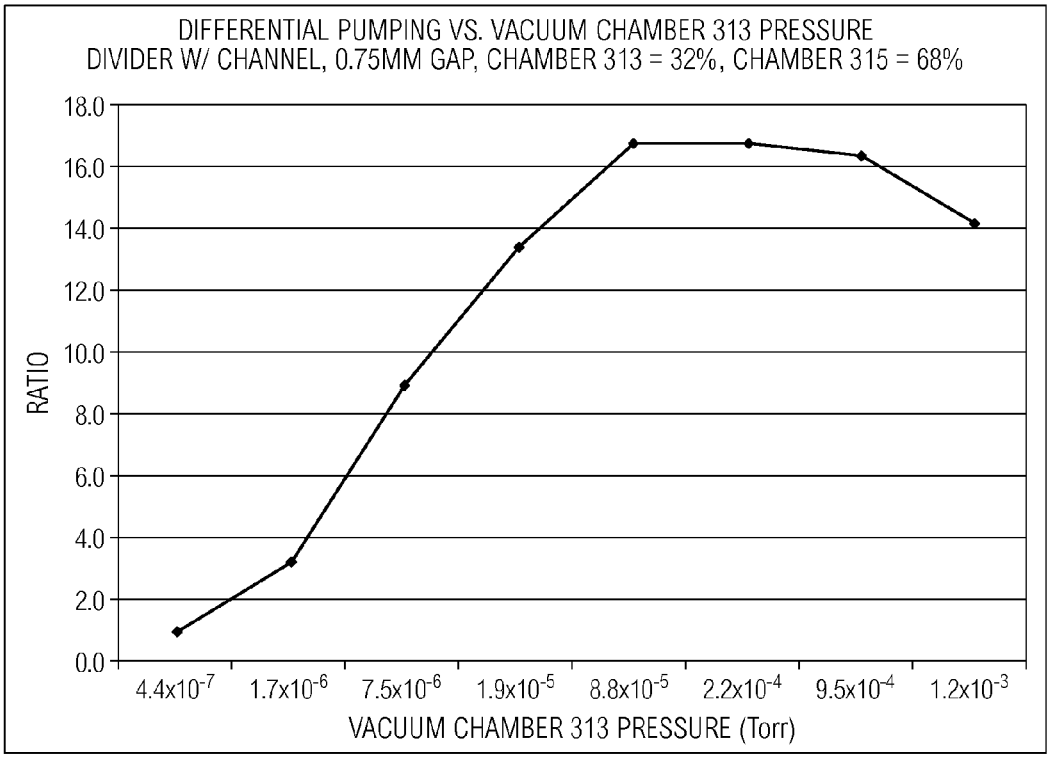
FIG. 7 is a graph illustrating the differential pumping the vacuum divider provides.

FIG. 7 is a graph illustrating DPR (vertical axis) as a function of the pressure of the vacuum chamber 313 (horizontal axis) for an optimum combination of the parameters. The divider design of FIG. 5 having the channel 501 was used. The distance between the rotor-blade-directed face 503 and the rotor blades 107 was set to 0.75 mm. The pump inlet area allocation was set at 32% for the vacuum chamber 313 and 68% for the vacuum chamber 315. The pressure of the vacuum chamber 313 was increased by opening the precision leak valve and at each data point the DPR was calculated.

Previous to the testing of the present invention, the expectation would be to obtain a DPR of between 3 and 5. However, it was found that the present invention easily produces a DPR of more than 5, or even a DPR of more than 10. Moreover, for this particular configuration utilizing the vacuum divider 101 of the present invention, and when the gas load was increased to the point where the pressure in the vacuum chamber 313 was approximately $1.0\times10^{-4}$ Torr, the results showed that the vacuum divider worked together with the turbo-molecular pump and vacuum manifold in an unexpected and fruitful manner to produce an amazing DPR of 17! This is about a quadruple improvement over what would previously have been expected.

Some general observations of the effects of the different parameters on the DPR are now explained.

The divider design of FIG. 5 with the channel 501 formed in the rotor-blade-directed face 503 was found to produce a 6% to 14% improvement in the DPR compared to that of the divider of FIG. 4 having the flat rotor-blade-directed face 401.

It was expected that smaller gap distances between the vacuum divider and the rotor blades would result in an improved DPR. This was indeed shown in the experiments, but the effect was relatively small. Changing the gap distance from 0.75 mm to 1.50 mm resulted in only a 7% reduction in the DPR. In general it can be desirable to set the gap distance at 1.50 mm or less.

On the other hand, the pump inlet area allocation had a significant effect on the DPR. As mentioned above, the test setup was configured in two ways with regard to the pump inlet area allocation. The pump inlet area allocation was set at 68% for the vacuum chamber 313 and 32% for the vacuum chamber 315 and also set at 32% for the vacuum chamber 313 and 68% for the vacuum chamber 315. The DPR more than doubled when the pump inlet area allocation was switched from 68% for the vacuum chamber 313 and 32% for the vacuum chamber 315 to 32% for the vacuum chamber 313 and 68% for the vacuum chamber 315.

Figure 8:
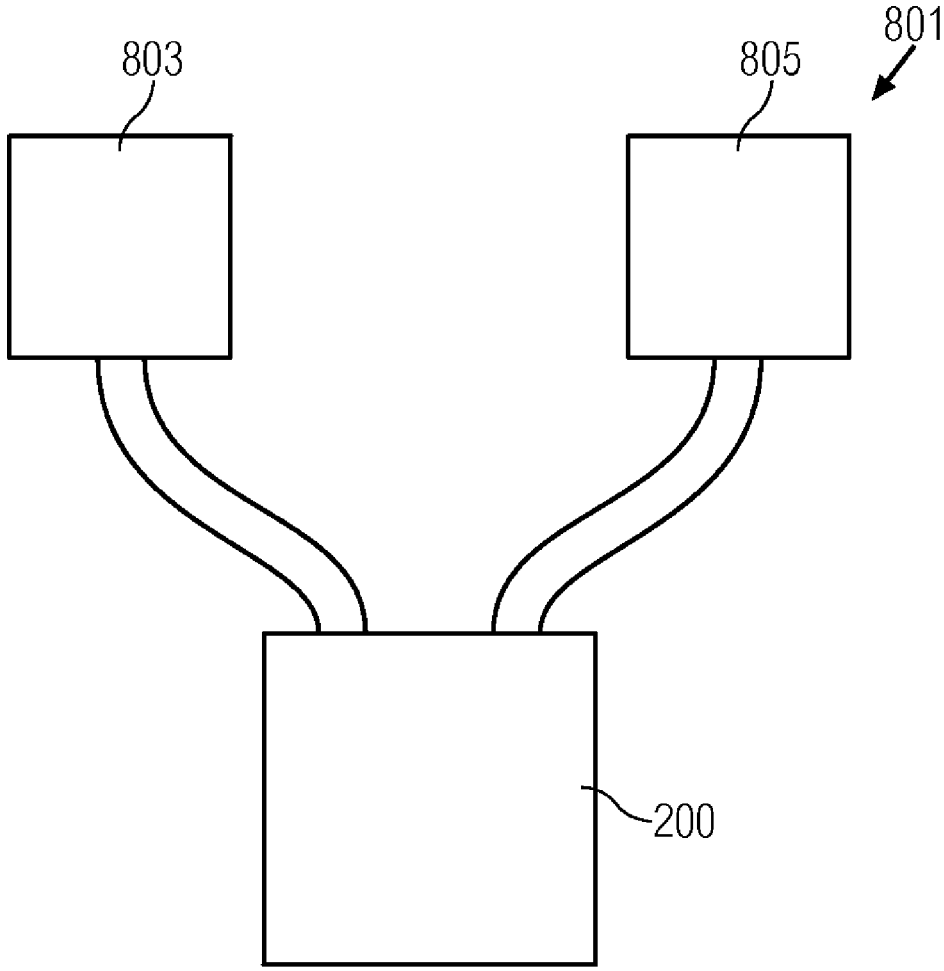
FIG. 8 is a diagrammatic view of a mass spectrometer system utilizing the vacuum assembly of FIG. 2 to separately evacuate an ion optics chamber and a mass analyzer chamber to different vacuum pressures.

The vacuum divider 101 of the present invention can be used with a turbo-molecular pump, such as the Pfeiffer TMH 262-020 YP, to provide differential pumping for an Agilent Technologies 6110 Single quad LCMS for example. FIG. 8 is a diagrammatic view of a mass spectrometer system 801 utilizing the portion of the vacuum assembly 200 of FIG. 2 to separately evacuate an ion optics chamber 803 and a mass analyzer chamber 805 to different vacuum pressures. The ion optics chamber 803 can contain an ion guide, a collision cell, or other ion optics elements. The ion optics chamber 803 can be evacuated through the first vacuum chamber 313 and the mass analyzer chamber 805 can be evacuated through the second vacuum chamber 315.

In another embodiment, the relative sizes of the coupling apertures 301, 303 can be adjustable. For example at least one of the coupling apertures 301, 303 can be an adjustable iris. Thus the pump inlet area allocation can be varied and in this way, the relative pressures of the vacuum chambers 313, 315 and thereby the relative pressures of the ion optics chamber 803 and mass analyzer chamber 805 can be fine tuned.

By adjusting the various parameters, such as the pump inlet area allocation, the measured DPRs of the vacuum chambers 313, 315 can be customized for particular applications. The DPRs can be adjusted to, for example, at least 2, 3, 4, 5, 6, 7, 8, 9, 10, 11, 12, 13, 14, 15, 16, 17, 18, 19 or 20.

In the present invention the gas referred to can be air or other gasses.

The vacuum divider can be made from aluminum, stainless steel, high performance engineering plastic or other known materials.

The present invention may be embodied in other forms without departing from its spirit and scope. The embodiments described above are therefore illustrative and not restrictive, since the scope of the invention is determined by the appended claims rather then by the foregoing description, and all changes that fall within the meaning and range of equivalency of the claims are to be embraced within their scope.

We claim:

1. A vacuum system, comprising:

a turbo-molecular pump having a plurality of rotor blades;

a vacuum manifold formed from multiple vacuum chambers; and a vacuum divider for positioning between rotor blades of the turbo-molecular pump and the vacuum manifold, said vacuum divider having, a first coupling aperture passing through the vacuum divider for allowing gas to pass from a first of the multiple vacuum chambers to the turbo-molecular pump, and a second coupling aperture passing through the vacuum divider for allowing gas to pass from a second of the multiple vacuum chambers to the turbo-molecular pump; and wherein the vacuum divider has a rotor-blade-directed face and is fixed relative to the turbo-molecular pump so that the closest distance between the face and the rotor blades of the turbo-molecular pump is less than 30% of a minimum width of the rotor-blade-directed face separating the coupling apertures to provide a differential pumping ratio ("DPR") between the first and second of the multiple vacuum chambers.

2. The vacuum system of claim 1, wherein a channel is formed in the rotor-blade-directed face.

3. The vacuum system of claim 1, wherein the rotor-blade directed face is a flat surface.

4. The vacuum system of claim 1, wherein the vacuum divider is attached to the turbo-molecular pump in a vacuum-tight arrangement.

5. The vacuum system of claim 1, wherein the vacuum divider is attached to the vacuum manifold in a vacuum-tight arrangement.

6. The vacuum system of claim 1, wherein the vacuum divider is integral with the turbo-molecular pump or the vacuum manifold.

7. The vacuum system of claim 1, wherein the coupling apertures are formed by radially extending ribs.

8. The vacuum system of claim 1, wherein each of the coupling apertures is fixed with a vacuum-tight seal to one of the vacuum chambers.

9. The vacuum divider of claim 1, wherein the relative sizes of the apertures are adjustable.

10. The vacuum divider of claim 1, wherein at least one of the apertures is an adjustable iris.

11. A vacuum system, comprising:

a turbo-molecular pump having a plurality of rotor blades;

a vacuum manifold formed from multiple vacuum chambers; and a vacuum divider for positioning between rotor blades of the turbo-molecular pump and the vacuum manifold, said vacuum divider having, a first coupling aperture passing through the vacuum divider for allowing gas to pass from a first of the multiple vacuum chambers to the turbo-molecular pump, and a second coupling aperture passing through the vacuum divider for allowing gas to pass from a second of the multiple vacuum chambers to the turbo-molecular pump; and additional coupling apertures passing through the vacuum divider for allowing gas to pass from at least a third one of the multiple vacuum chambers to the turbo-molecular pump.

12. A vacuum system, comprising:

a turbo-molecular pump having a plurality of rotor blades;

a vacuum manifold formed from multiple vacuum chambers; and a vacuum divider for positioning between rotor blades of the turbo-molecular pump and the vacuum manifold, said vacuum divider having, a first coupling aperture passing through the vacuum divider for allowing gas to pass from a first of the multiple vacuum chambers to the turbo-molecular pump, and a second coupling aperture passing through the vacuum divider for allowing gas to pass from a second of the multiple vacuum chambers to the turbo-molecular pump; wherein the first and second coupling apertures are separated by a rib crossing the vacuum divider;

the first and second of the multiple vacuum chambers are separated by a bulkhead wall; and the rib is disposed for alignment with the bulkhead wall so that the first coupling aperture and first vacuum chamber form a first continuous space and the second coupling aperture and second vacuum chamber form a second continuous space.

13. The vacuum system of claim 12, wherein the rib is disposed for vacuum-tight connection with the bulkhead wall.

14. A mass spectrometer, comprising:

a turbo-molecular pump having a plurality of rotor blades;

a vacuum manifold formed from multiple vacuum chambers; and a vacuum divider for positioning between rotor blades of the turbo-molecular pump and the vacuum manifold, said vacuum divider having, a first coupling aperture passing through the vacuum divider for allowing gas to pass from a first of the multiple vacuum chambers to the turbo-molecular pump, and a second coupling aperture passing through the vacuum divider for allowing gas to pass from a second of the multiple vacuum chambers to the turbo-molecular pump.

15. The mass spectrometer of claim 14, wherein the vacuum divider is integral with the turbo-molecular pump or the vacuum manifold.

16. A vacuum system, comprising:

a turbo-molecular pump having a plurality of rotor blades;

a vacuum manifold formed from multiple vacuum chambers; and a vacuum divider for positioning between rotor blades of the turbo-molecular pump and the vacuum manifold, said vacuum divider having, a first coupling aperture passing through the vacuum divider for allowing gas to pass from a first of the multiple vacuum chambers to the turbo-molecular pump, and a second coupling aperture passing through the vacuum divider for allowing gas to pass from a second of the multiple vacuum chambers to the turbo-molecular pump;

wherein there is a differential vacuum between the vacuum chambers connected through the apertures of the divider to the turbo-molecular pump.

17. The vacuum system of claim 16 wherein the differential vacuum has a DPR of more than 5.

18. The vacuum system of claim 16 wherein the differential vacuum has a DPR of more than 10.

* * * * *

UNITED STATES PATENT AND TRADEMARK OFFICE

CERTIFICATE OF CORRECTION

PATENT NO. : 8,147,222 B2
APPLICATION NO. : 11/749083
DATED : April 3, 2012
INVENTOR(S) : Alexander Mordehai et al.

It is certified that error appears in the above-identified patent and that said Letters Patent is hereby corrected as shown below:

Column 7, lines 5-6, in Claim 3, delete “blade” and insert -- blade-directed --, therefor.

Column 7, line 21, in Claim 9, delete “divider” and insert -- system --, therefor.

Column 7, line 23, in Claim 10, delete “divider” and insert -- system --, therefor.

Signed and Sealed this
Tenth Day of July, 2012

David J. Kappos

David J. Kappos
*Director of the United States Patent and Trademark Office*